United States Patent [19]

Miyazaki et al.

[11] Patent Number: 5,014,203

[45] Date of Patent: May 7, 1991

[54] ABNORMALITY DETECTING DEVICE FOR AN EGR SYSTEM

[75] Inventors: Masaaki Miyazaki; Hajime Kako, both of Himeji, Japan

[73] Assignee: Mitsubishi Denki K.K., Tokyo, Japan

[21] Appl. No.: 353,279

[22] Filed: May 17, 1989

[30] Foreign Application Priority Data

May 19, 1988 [JP] Japan ..... 63-124227

[51] Int. Cl.[5] ..... F02M 25/07; G08B 21/00

[52] U.S. Cl. ..... 364/431.06; 123/571

[58] Field of Search ..... 364/431.06, 431.11, 364/431.12; 123/571

[56] References Cited

U.S. PATENT DOCUMENTS

| | | | |
|---|---|---|---|
| 4,462,376 | 7/1984 | Ripper et al. | 123/571 |
| 4,770,146 | 9/1988 | Shibata et al. | 123/571 |
| 4,793,318 | 12/1988 | Tsurusaki | 123/571 |
| 4,794,903 | 1/1989 | Suzuki | 123/571 |
| 4,834,054 | 5/1989 | Hashimoto et al. | 123/571 |
| 4,870,942 | 10/1989 | Shibata et al. | 123/571 |
| 4,967,717 | 11/1990 | Miyazaki et al. | 123/571 |

*Primary Examiner*—Felix D. Gruber

*Attorney, Agent, or Firm*—Sughrue, Mion, Zinn, Macpeak & Seas

[57] ABSTRACT

An abnormality detecting device for an EGR system comprises an EGR valve disposed in an EGR passage to control a flow rate of exhaust gas recirculated therethrough, a first temperature detecting device disposed in the EGR passage to detect the temperature of the same, a second temperature detecting device disposed in the intake air passage of an internal combustion engine, an operational condition detecting device to output parameters of the engine or the EGR valve as signals indicating operational conditions of the engine, an EGR abnormality determining zone discriminating device adapted to discriminate that the operational conditions are in a predetermined EGR abnormality determining zone in the operable area of the engine or the EGR valve in which recirculation of the exhaust gas is controlled by the EGR valve, and an abnormality determining device to determine abnormality in the EGR system on the basis of a quantitative relation between a value of the EGR abnormality determining temperature which is obtained by the calculation of the operational conditions and an output signal of the second temperature detecting device, and a value of the temperature of the EGR passage detected by the first temperature detecting device.

6 Claims, 8 Drawing Sheets

ABNORMALITY DETECTING DEVICE FOR AN EGR SYSTEM

BACKGROUND OF THE INVENTION

1. Field of the Invention

The present invention relates to an abnormality detecting device for an EGR system to detect abnormality in exhaust gas recirculation (EGR) in an internal combustion engine with such an EGR system.

2. Discussion of Background

A conventional abnormality detecting device of this type is so adapted that an output of an EGR temperature sensor for detecting temperature in an EGR passage is compared with a predetermined value which corresponds to the output of the EGR temperature sensor, which is assumed to be produced when an abnormal condition such as clogging takes place in the EGR system therefor the output of the EGR temperature sensor is lower than the predetermined value, judgement of the abnormality of the EGR system is made, or an output of the EGR temperature sensor is compared with an output of an intake air temperature sensor attached to an intake air manifold. When the output of the EGR temperature sensor is lower than the output of the intake air temperature sensor, judgement of the abnormality of the EGR system is made.

The conventional abnormality detecting device for an EGR system having the above-mentioned construction has a problem that it can make judgement of abnormality only when an exhaust gas recirculation rate is substantially constant. Accordingly, a region for the judgement of abnormality is narrow and a chance of detecting abnormality of the EGR system is small.

SUMMARY OF THE INVENTION

It is an object of the present invention to provide an abnormality detecting device for an EGR system capable of quickly and accurately detecting abnormality in the EGR system in a wide range of operation.

The foregoing and other objects of the present invention have been attained by providing an abnormality detecting device for an EGR system which comprises:

an EGR valve disposed in an EGR passage to control a flow rate of exhaust gas recirculated therethrough, a first temperature detecting means disposed in the EGR passage to detect the temperature of the same, a second temperature detecting means disposed in the intake air passage of an internal combustion engine, an operational condition detecting means to output parameters of the engine or the EGR valve as signals indicating operational conditions, an EGR abnormality determining zone discriminating means adapted to discriminate that the operational conditions are in a predetermined EGR abnormality determining zone in the operable area of the engine or the EGR valve in which recirculation of the exhaust gas is controlled by the EGR valve, and an abnormality determining means to determine abnormality in the EGR system on the basis of a quantitative relation between a value of EGR abnormality determining temperature which is obtained by the calculation of the operational conditions and an output signal of the second temperature detecting means and a value of the temperature of the EGR passage detected by the first temperature detecting means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
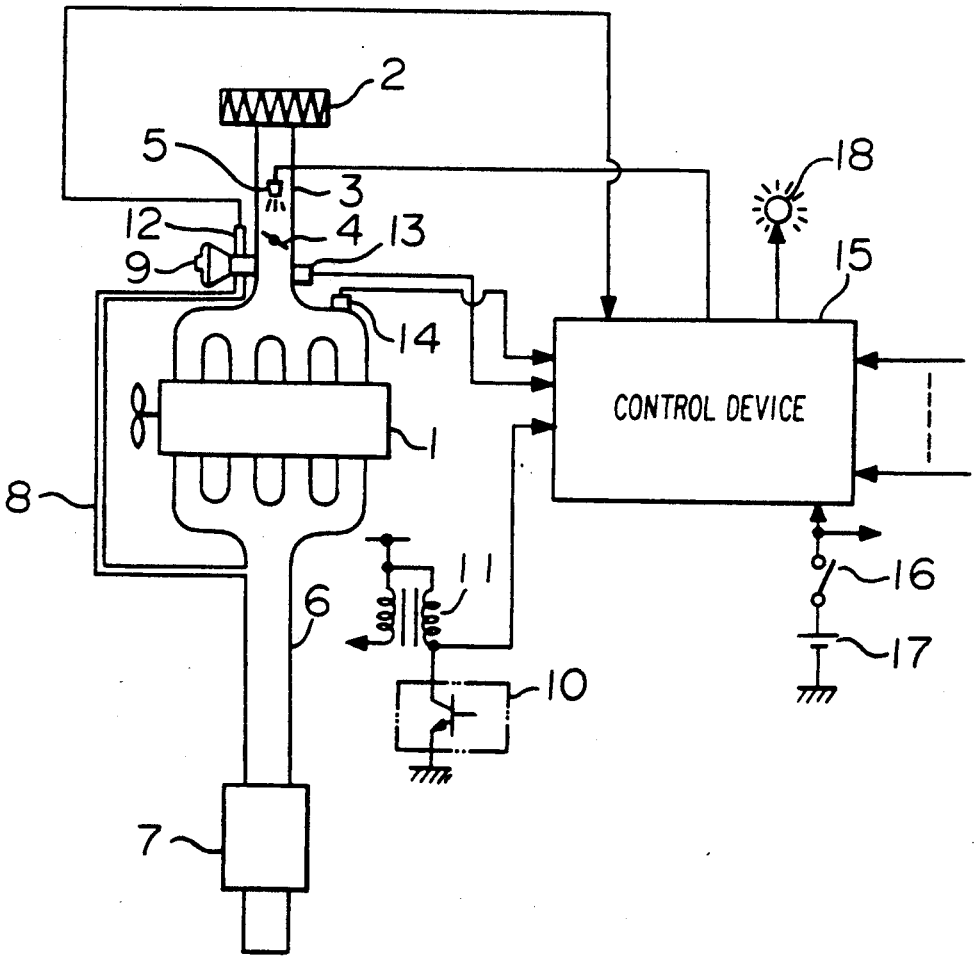
FIG. 1 is a diagram of an embodiment of the abnormality detecting device according to the present invention.

Referring to the drawings, wherein the same reference numerals designates the same or corresponding parts throughout the several views, and more particularly to FIGS. 1–7, there is shown an embodiment of an abnormality detecting device for an EGR system of the present invention. FIG. 1 shows an embodiment of the abnormality detecting device of the present invention wherein a reference numeral 1 designates an engine mounted on an automobile, a numeral 2 designates an air cleaner, a numeral 3 designates an intake air pipe, a numeral 4 designates a throttle valve disposed in the intake air pipe 3, a numeral 5 designates an injector disposed in the intake air pipe 3 at a position upstream from the throttle valve 4, a numeral 6 designates an exhaust manifold, a numeral 7 designates a three-way catalyst converter, and a numeral 8 designates an EGR passage through which exhaust gas is recirculated. An end of the EGR passage is communicated with the exhaust manifold 6 and the other end is communicated with the intake air pipe 3 at the downstream side from the throttle valve 4 through an EGR valve 9 which adjusts a recirculation rate of the exhaust gas. The EGR valve is of a well-known type which is opened or closed due to a pressure difference between an atmospheric pressure and a pressure in the intake air pipe.

A numeral 10 designates an ignitor which receives a signal from a signal generator (not shown) disposed in a distributor (not shown) to feed or break a current to the primary winding of an ignition coil, a numeral 12 designates an EGR temperature sensor disposed in the EGR passage 8 at a position near the EGR valve 9, a numeral 13 designates a pressure sensor to detect a pressure as a value of the absolute pressure in the intake air pipe at the downstream side of the throttle valve 4, and a numeral 14 designates an intake air temperature sensor disposed in the intake manifold of the intake air pipe 3.

A numeral 15 designates a control device to receive power from a battery 17 through a key switch 16, the control device being so constructed that it receives output signals from the above-mentioned sensors 12–14 and receives an ignition signal from the ignitor 10, whereby it judges conditions of the EGR system on the basis of the input signals, and when it judges the system to be abnormal, an alarm lamp 18 is lit.

Figure 2:
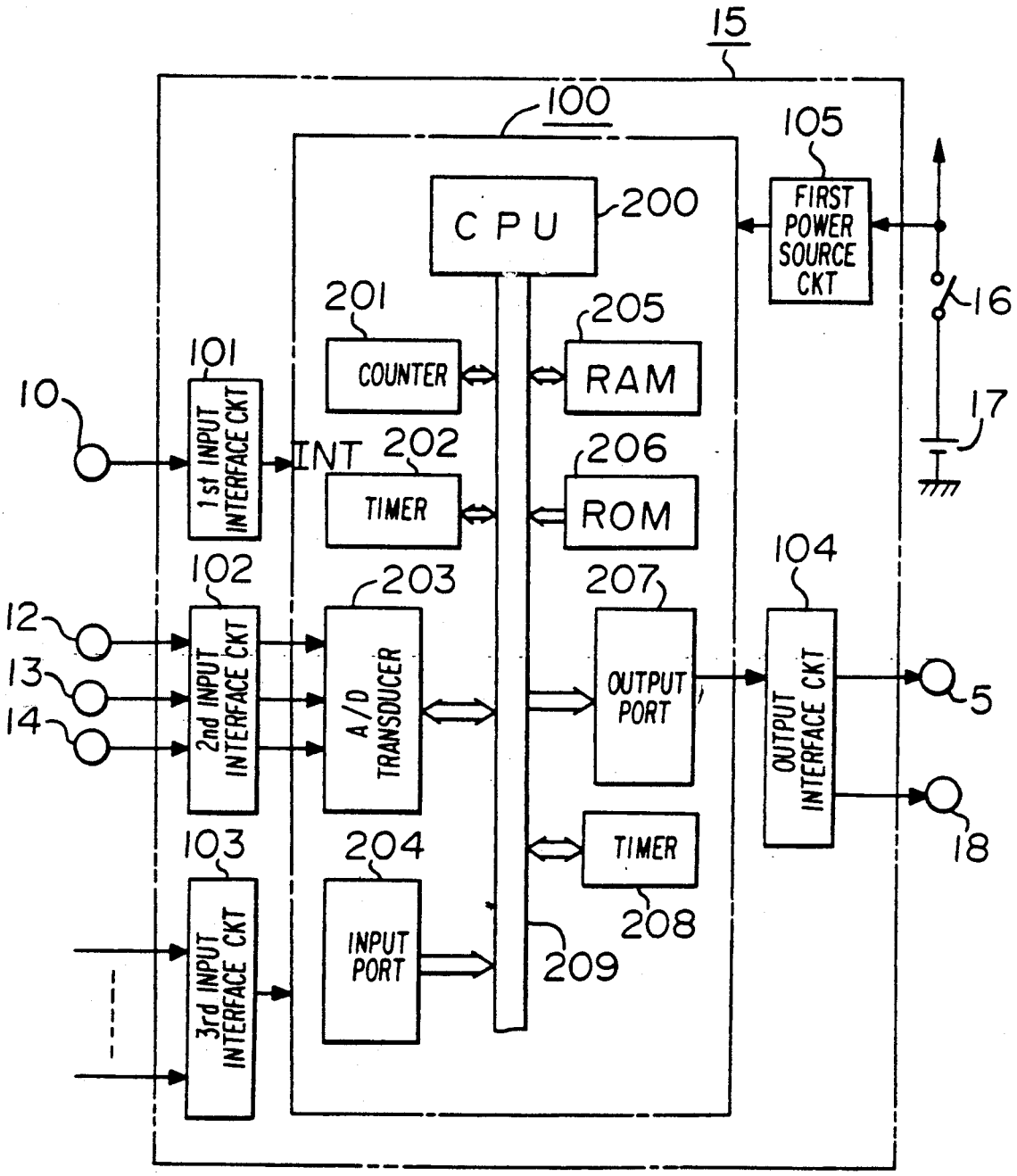
FIG. 2 is a block diagram showing the construction of a control device shown in FIG. 1.
Figure 3:
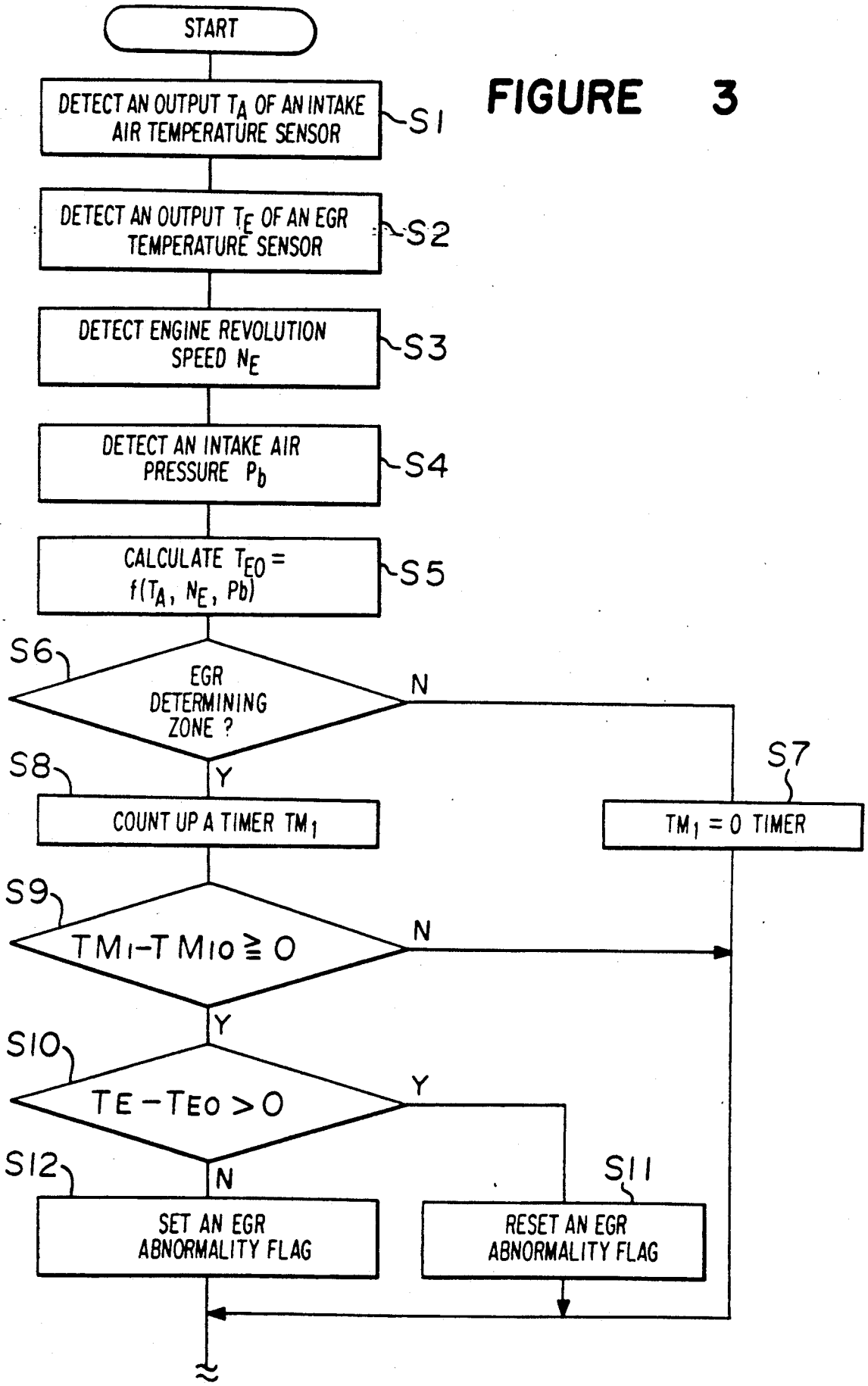
FIG. 3 is a flow chart showing an example of the operation of a CPU in the control device shown in FIG. 1.

FIG. 2 is a diagram showing an embodiment of the control device 15 according to the present invention. In FIG. 2, a numeral 100 designates a microcomputer which comprises a CPU 200, a counter 201, a timer 202, an A/D transducer 203, an input port 204, an RAM 205, an ROM 206 which stores the flow of steps as shown in FIG. 3 as a form of a program, an output port 207, a timer 208 to measure a period of signals outputted from the output port 207 and a bus 209 and so on. The control device 15 is also provided with a first input interface circuit 101 which regulates the shape of the ignition signals from the ignitor 10 to execute the interruption of a routine to the microcomputer 100, a second input interface circuit 102 adapted to regulate the shape of the analogue signals outputted from the above-mentioned sensors 12–14 and to remove noise components, and to input the shaped analogue signals to the A/D transducer 203, a third input interface circuit 103 to input other signals to the input port 204. A numeral 104 designates an output interface circuit which receives a signal outputted from the output port 207 and generates a driving signal to the injector 5 or alarm lamp 18. A numeral 105 designates a first power source circuit to supply power of the battery 17 to the microcomputer 100 through the key switch 16.

The operation of the control device will be described with reference to FIGS. 1 and 2.

Air for combustion is sucked into the engine 1 via the air cleaner 2 and the intake air pipe 3 at an amount corresponding to a degree of opening of the throttle valve 4. A part of the exhaust gas from the engine is recirculated in the intake air pipe 3 through the EGR passage 8 at an amount corresponding to a degree of opening of the EGR valve 9, and the recirculated exhaust gas is mixed with the air for combustion to be sucked into the engine 1. Ignition is effected in such a manner that the ignitor 10 changes the primary side of the ignition coil 11 from an ON state to an OFF state to produce an ignition signal and an ignition signal of a high voltage which is produced at the secondary side of the ignition coil 11 fires a predetermined ignition plug (not shown) in the engine 1. In synchronism with the ignition at the predetermined ignition plug, fuel is ejected from the injector 5 to the intake air pipe 3.

A part of the exhaust gas, after the combustion operation, is recirculated in the intake air pipe 3 as described above, and the rest is discharged outside through the exhaust manifold 6 and the three-way catalyst converter 7.

On the other hand, when the control device receives power from the battery 17 by the operation of the key switch 16, the device starts its operations. The EGR temperature sensor 12 detects a temperature in the EGR passage 8; the pressure sensor 13 detects a pressure in the intake air pipe 3, and the intake air temperature sensor 14 detects a temperature of air sucked in the intake air pipe 3. Analogue signals detected by the sensors 12, 13, 14 are inputted in the A/D transducer 203 through the second input interface circuit 102 and are succesively changed from the analogue signals to digital signals in the A/D transducer 203 to be respectively an EGR temperature value $T_E$, an intake air pipe pressure value Pb and an intake air temperature value $T_A$.

The ignition signal of the igniter 10 is inputted in the first input interface circuit 101 and then to the microcomputer 100 to effect an interrupting operation for an interruption routine, the CPU 200 reads a measured value on an ignition signal generating period from the counter 201 and stores the measured value in the RAM 205.

The operation of the CPU 200 in the control device 15 will be described in accordance with the interruption routine as shown in FIG. 3 which is effected at each predetermined time.

At Step S1, an intake air temperature value $T_A$ representing an intake air temperature is detected through the intake air temperature sensor 14. At Step S2, an EGR temperature value $T_E$ representing a temperature in the EGR passage 8 is detected through the EGR temperature sensor 12. At Step S3, a revolution speed value $N_E$ representing an engine revolution speed is calculated on the basis of the measured value of ignition signal generating period which is read from the RAM 205. The values detected and calculated are respectively stored in the RAM 205 at each of the Steps.

At Step S4, an intake air pipe pressure value Pb representing an intake air pipe pressure is detected through the pressure sensor 13. At Step S5, an EGR abnormality determining temperature value $T_{E0}$, which is used to detect abnormality in the EGR system caused by for instance a clogging phenomenon in the EGR system, is calculated by using the intake air temperature value $T_A$, the revolution speed value $N_E$ and the intake air pipe pressure value Pb, and the calculated value is stored in the RAM 205. The EGR abnormality determining temperature value $T_{E0}$ increases as the intake air temperature value $T_A$, the revolution speed value $N_E$ and the intake air pipe pressure value Pb increase.

Figure 4:
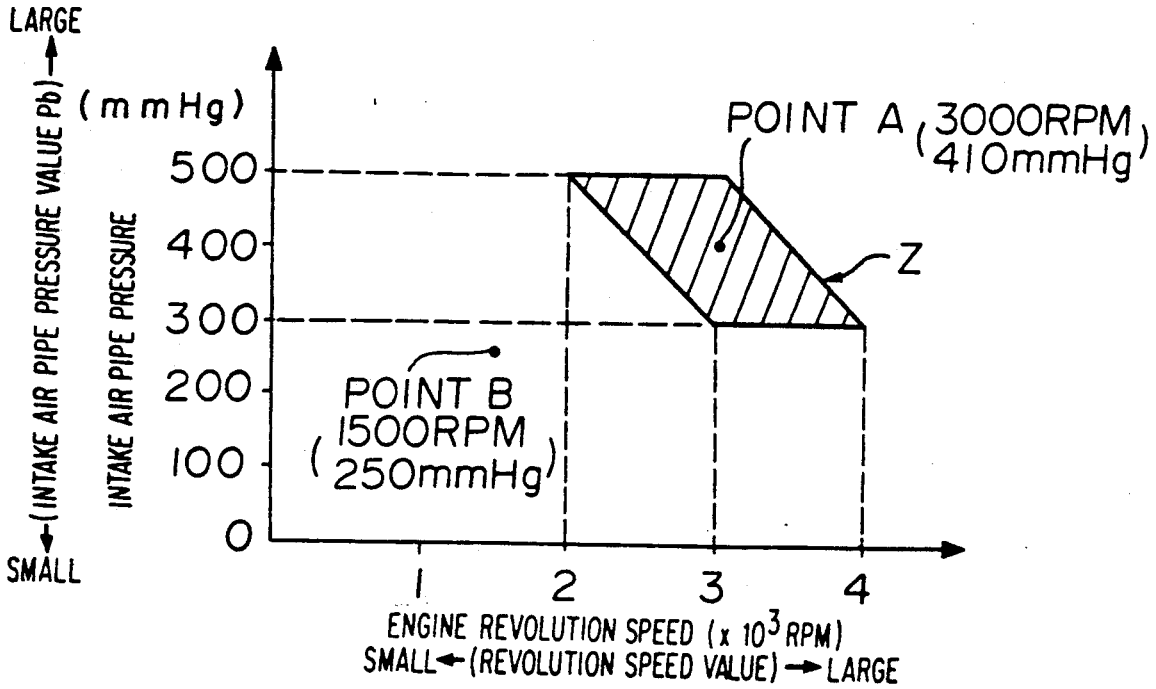
FIG. 4 is a diagram illustrating an EGR abnormality determining zone.

At Step S6, determination is made as to whether or not operational conditions determined by the detected revolution speed value $N_E$ and the intake air pipe pressure value Pb fall in an EGR abnormality determining zone Z, which is indicated by hatching in FIG. 4, in an operable area in which exhaust gas recirculation is performed by the EGR valve 9. When the operational conditions are out of the EGR abnormality determining zone Z, then Step S7 is taken. On the other hand, when the conditions are in the zone Z, then, Step 8 is taken. The EGR abnormality determining zone Z as shown in FIG. 4 is previously stored in the ROM 206 in a form of a map in a relation of the revolution speed to the intake air pipe pressure value.

At Step S7, a first timer value $TM_1$ in the timer 202 is rendered to be 0, and at Step S8, the first timer value $TM_1$ is counted up.

At Step 9, a determination is made as to whether or not a difference between the first timer value $TM_1$ of the timer 202 and a first predetermined value $TM_{10}$ is equal to or higher than 0. When $TM_1 \geqq TM_{10}$ and the difference between them is equal to or higher than 0, then, sequential step moves to Step S10 where determination is made as to whether or not a difference $T_E - T_{E0}$ between the EGR temperature value $T_E$ and the EGR abnormality determining temperature value $T_{E0}$ is higher than 0. When positive judgement is made at both Steps S9 and S10, the resetting of an EGR abnormality flag is effected in the RAM 205 at Step S11. On the other hand, when $T_E < T_{E0}$ and the difference between them does not exceed 0, the setting of the EGR abnormality flag is effected in the RAM 205 at Step S12.

After the operation of Step S7 is finished, or the determination of $TM_1 < TM_{10}$ is provided at Step S9, or after the operation of Step S11 is finished, or the operation of S12 is finished, the next Step (not shown) is taken.

Calculations for the EGR abnormality determining temperature value $T_{E0}$ are carried out as follows, for example.

Figure 5:
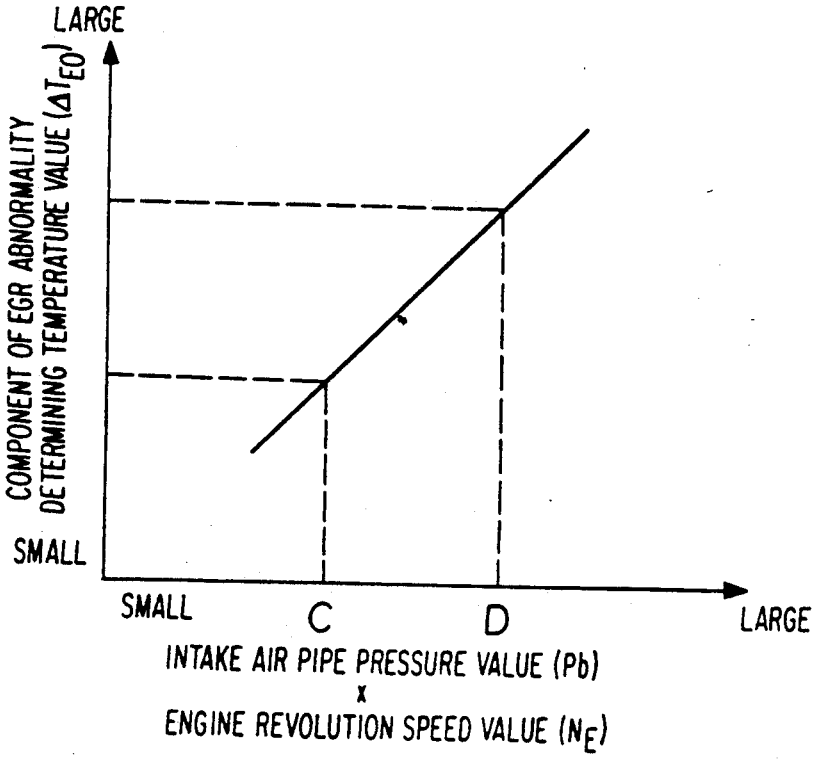
FIG. 5 is a diagram showing an example of a change of a component of EGR abnormality determining temperature value which corresponds to a change in a value of the product of a revolution speed value and a pressure value of an intake air pipe.

When an amount of air sucked into the engine is increased, the EGR temperature value $T_E$ is also increased because the recirculation rate of the exhaust gas is increased in the EGR system. Accordingly, the EGR abnormality determining temperature value $T_{E0}$ has to be increased in correspondence to the increased amount of air sucked to the engine 1. As shown in FIG. 5, the product of the revolution speed value $N_E$ and the intake air pipe pressure value Pb at the abscissa takes a value close to a value of an amount of intake air. Namely, the value increases in correspondence to an increased amount of air sucked to the engine 1 (the EGR rate is also increased).

The value $\Delta T_{E0}$ at the ordinate is a component of the EGR abnormality determining temperature value $T_{E0}$ and is in a relatiOn of proportion to $N_E \times Pb$. Accordingly, the EGR abnormality determining temperature component $\Delta T_{E0}$ corresponding to an amount of intake air is calculated in a relation of a value obtained by multiplying a revolution speed value $N_E$ and an intake air pipe pressure value Pb to data in a form of a map as shown in FIG. 5 which are previously stored in the ROM 206, and the EGR abnormality determining temperature value $T_{E0}$ is calculated by performing the calculation of $\Delta T_{E0}$.

Figure 6:
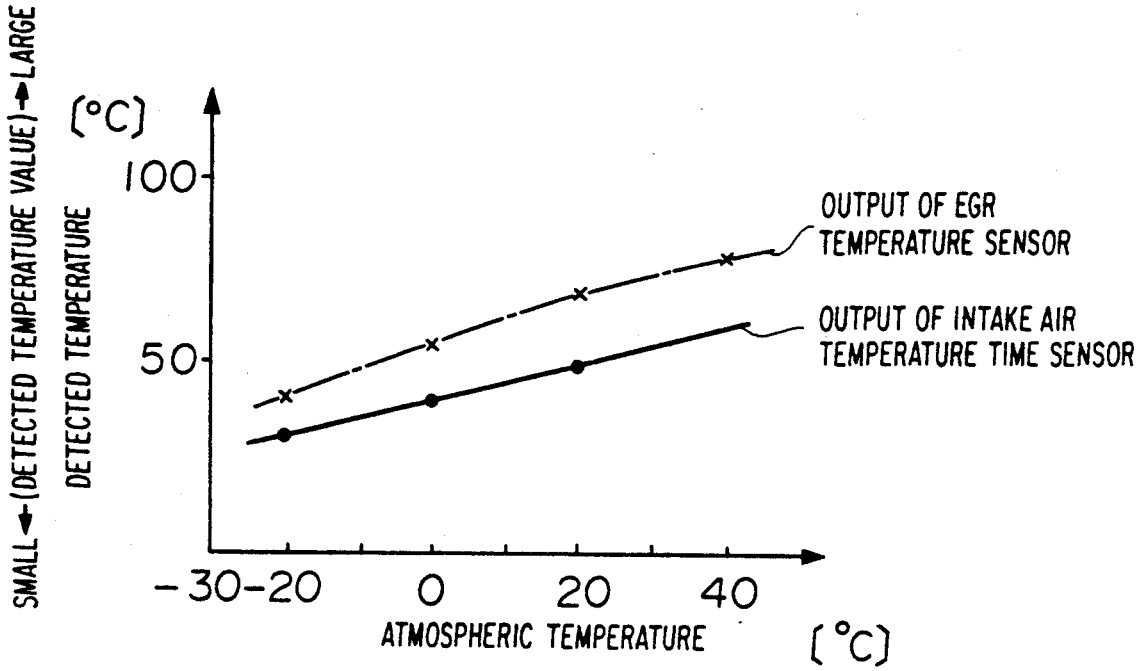
FIG. 6 is a diagram showing an example of a relation of outer temperature to detected temperature.

As shown in FIG. 6, the output of the EGR temperature sensor 12, i.e. the EGR temperature value $T_E$ is generally apt to be influenced by an atmospheric temperature, namely, the temperature value $T_E$ decreases as the atmospheric temperature decreases. The output of the intake air temperature sensor 14, i.e. the intake air temperature value $T_A$, similarly decreases as the atmospheric temperature decreases. Accordingly, the EGR abnormality determining temperature value $T_{E0}$ having a relation of proportion to the intake air temperature value $T_A$ is also decreased, and the difference between the EGR temperaure value $T_E$ and the EGR abnormality determining temperature value $T_{E0}$ is not substantially influenced by the atmospheric temperature.

Figure 7:
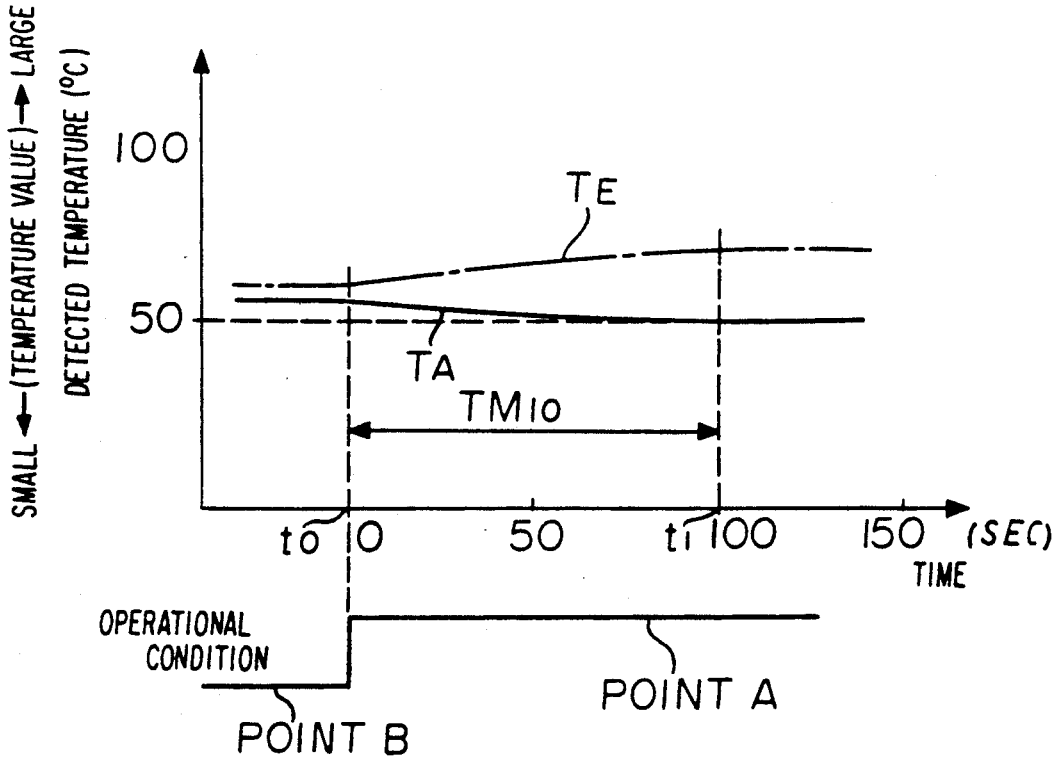
FIG. 7 is a diagram showing a transient characteristic of an intake air temperature value and an EGR temperature value.

FIG. 7 shows transient characteristics of the intake air temperature value $T_A$ and the EGR temperature value $T_E$ caused when the operational conditions are moved from the outside of the EGR abnormality determining zone Z (for instance, a point B having values of 1,500 rpm and 250 mmHg) to the inside of the EGR abnormality determining zone Z (for instance, a point A having values of 3,000 rpm and 410 mmHg), the determining zone being shown in FIG. 4. There is found a change in the signals $T_A$, $T_E$ within a time from a time point $t_0$ at which the operational conditions are changed from the point B to the point A, to a time point $t_1$, the time corresponding to a value $TM_{10}$ in the first timer, however, after the time point $t_1$, the signals $T_A$, $T_E$ become stable, and accordingly, judgement of the abnormality can be made with high accuracy.

Figure 8:
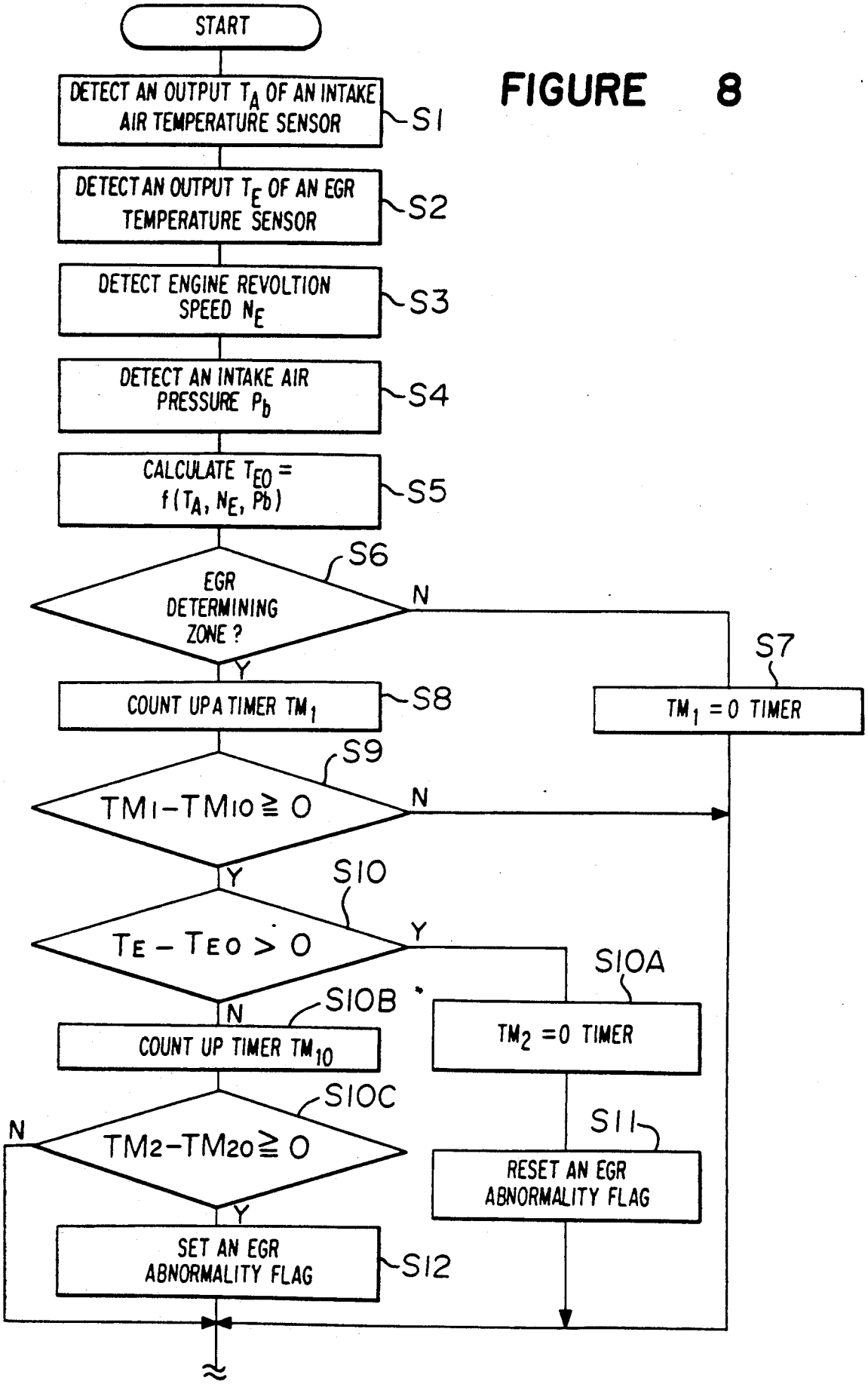
FIG. 8 is a flow chart showing an example of the operation of the CPU in a second embodiment of the present invention.

A second embodiment of the abnormality detecting device of the present invention will be described. The construction of the second embodiment is substantially the same as the construction of the first embodiment as shown in FIGS. 1 and 2 except that a first timer (having a first timer value $TM_1$) and a second timer (having a second timer value $TM_2$) are used instead of the timer 202, and the ROM 206 stores a flow of Steps as shown in FIG. 8 in a form of a program. Accordingly, description of the same construction and the operations as the first embodiment is omitted. In FIG. 8, the same reference numerals as in FIG. 3 are used.

The operation of the CPU 200 in the control device 15 of the second embodiment will be described with reference to FIG. 8. An interruption routine as shown in FIG. 8 is effected for each predetermined time. The operations of Steps S1-S10 are described with reference to FIG. 3, and accordingly, description of these Steps is omitted.

At Step S10, determination is made as to whether to not an EGR temperature value $T_E$ is greater than an EGR abnormality determining temperature value $T_{E0}$. When YES, the value $TM_2$ of the second timer is rendered to be 0 at Step S10A. On the other hand, when $T_E \leqq T_{E0}$, the value $TM_2$ of the second timer is counted up. After the operation at Step S10A, an EGR abnormality flag is reset to indicate that the EGR is in a normal condition at Step S11. After the operation at Step S10B, determination is made as to whether or not the value $TM_2$ of the second timer is equal to or greater than a second predetermined value $TM_{20}$ at Step S10C. When YES, the EGR abnormality flag is set at Step S12, namely, it shows that the EGR system is in an abnormal condition.

After the value $TM_1$ of the first timer is rendered to be 0 at Step S7, or when the value $TM_1$ of the first timer does not reach or exceed the first predetermined value $TM_{10}$, i.e. the timer in the first timer does not lapse the first predetermined value at Step S9, or when the value $TM_2$ of the second timer does not reach or exceed the second predetermined value $TM_{20}$, i.e. the time in the second timer does not lapse the second predetermined value at Step S10C, or after the operation of the Step S11 is finished, or the operation of the Step S12 is finished, sequential operation goes to the next Step (not shown).

As shown in FIG. 5, when a value of the product of the revolution speed value $N_E$ and the intake air pipe pressure value Pb increases and it moves from a point C to a point D within the EGR abnormality determining zone Z (as shown in FIG. 4), the component $\Delta T_{E0}$ of the EGR abnormality determining temperature value is also increased. Accordingly, the EGR abnormality determining temperature value $T_{E0}$ is increased at a time point $T_{10}$ in FIG. 9. In the second embodiment, a result of the judgement of abnormality in the EGR system is not provided because the EGR temperature value $T_E$ is still in a transient time at the time point $T_0$, and the result is provided at a time after the second predetermined time has passed, i.e. a time corresponding to the second predetermined value $TM_{20}$ has passed so that the EGR temperature value $T_E$ is stabilized.

Figure 9:
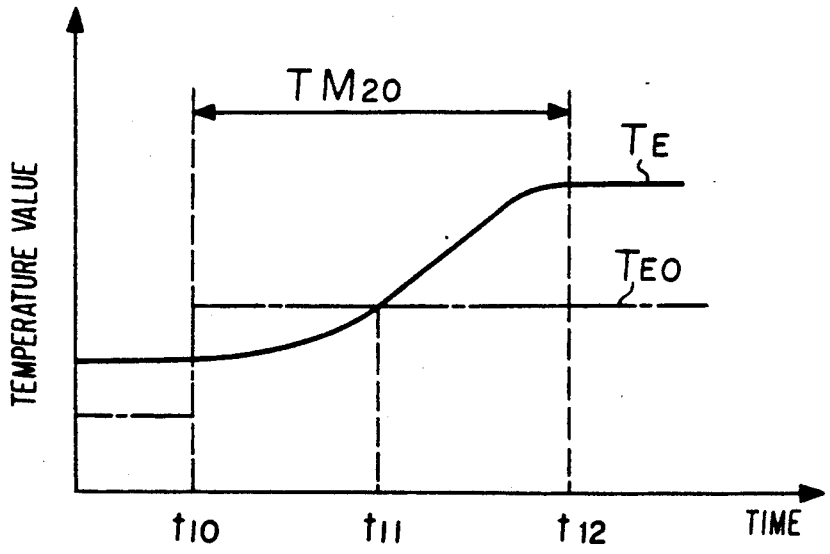
FIG. 9 is a diagram showing an example of a transient characteristic of an EGR temperature value when operational conditions change in an EGR abnormality determining zone.

In FIG. 9, $T_{E0} > T_E$ at the time point $T_{10}$, and then, $T_{E0} = T_E$ at the time point $T_{11}$, and thereafter, $T_{E0} < T_E$ at the time point $T_{12}$. Accordingly, there is a risk of erroneous judgement when a result of the judgement of abnormality in the EGR system is provided at the time point $T_{10}$.

In the second embodiment, a time of about 80 sec–100 sec is required for the first predetermined time (corresponding to the first predetermined value $TM_{10}$). On the other hand, a shorter time of about 15 sec–20 sec is required for the second predetermined time (corresponding to the second predetermined value $TM_{20}$).

In the first and second embodiments, the EGR temperature sensor 12 is mounted on the EGR valve 9. However, the same function is obtainable by mounting the EGR temperature sensor 12 on the EGR passage 8 at the feeding side or the outlet side with respect to the EGR valve 9.

In the above-mentioned embodiments, the intake air temperature sensor 14 is attached to the intake manifold of the intake air pipe 3. However, the same function is obtainable even by attaching it to the intake air passage such as the throttle body portion or the surge tank in the intake air pipe 3.

Further, in the above-mentioned embodiments, the engine revoluton speed and the intake air pipe pressure value are used and the EGR abnormality determining temperature value is calculated by the intake air temperature value as well as the engine revolution speed and the intake pipe pressure value in order to obtain the operational conditions. However, it is possible to use at least one signal of an engine revolution speed value, an intake air pipe pressure value and intake air flow rate which is detected by an air flow sensor. Further, it is possible to use a pressure value for the EGR valve representing a control pressure for the EGR valve or the output value of a valve position sensor for the EGR valve.

Figure 10:
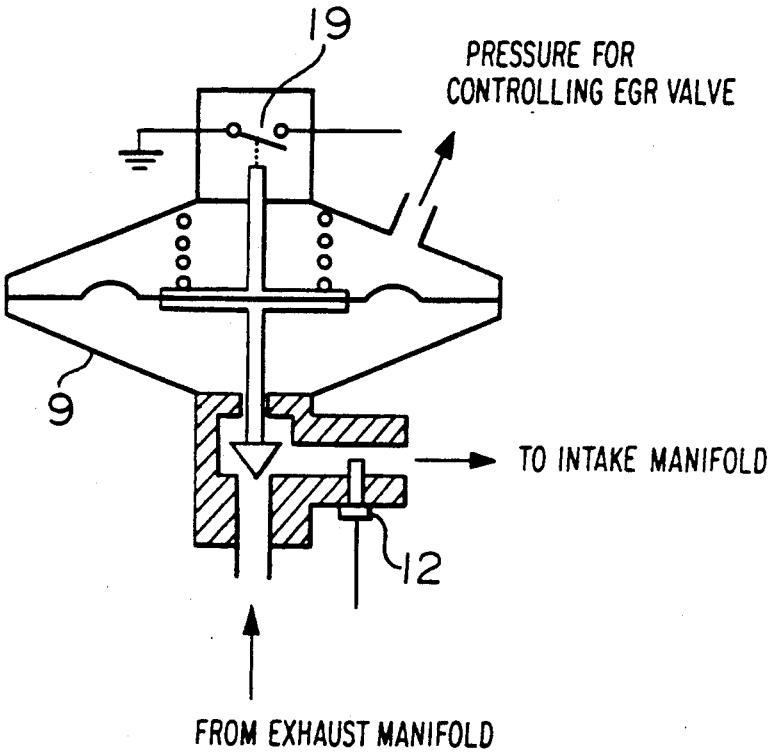
FIG. 10 is a diagram showing an example of the construction of an EGR valve with an EGR valve position detecting switch.

FIG. 10 is a diagram showing an example of an EGR valve position detecting switch 19 which is adapted to be turned on when the EGR valve opens by a predetermined value or more. At Step 6 in FIG. 3 or FIG. 8, when the EGR valve position detecting switch is open, a determination that the operational conditions are outside the EGR abnormality determining zone is made; then sequential step goes to Step 7. On the other hand, when the switch is closed, a determination that the operational conditions are inside the determining zone is made; then Step 8 is taken.

Thus, in accordance with the present invention, an EGR abnormality determining temperature value is determined in accordance with the operational conditions as the parameters of the engine and the EGR valve, and judgement of the abnormality of the EGR system is made on the basis of the comparison of the EGR abnormality determining temperature value with the EGR temperature value indicating the temperature of the EGR passage when the operational conditions fall in the EGR abnormality determining zone. Accordingly, the abnormality of the EGR system can be quickly, accurately detected.

Obviously, numerous modifications and variations of the present invention are possible in light of the above teachings. It is therefore to be understood that within the scope of the appended claims, the invention may be practiced otherwise than as specifically described herein.

What is claimed is:

1. An abnormality detecting device for an exhaust gas recirculation (EGR) system which comprises:

an EGR valve disposed in an EGR passage to control a flow rate of exhaust gas recirculated therethrough, a first temperature detecting means disposed in said EGR passage to detect the temperature thereof, a second temperature detecting means disposed in an intake air passage of an internal combustion engine, an operational condition detecting means, coupled to said engine and said air intake air passage, to output parameters of said engine as signals indicating operational conditions of said system;

an EGR abnormality determining zone discriminating means for discriminating, based upon an input from said operational condition detecting means, that said operational conditions are in a predetermined EGR abnormality determining zone in the operable area of said engine in which recirculation of the exhaust gas is controlled by said EGR valve, and an abnormality determining means for determining abnormality in the EGR system, based on said output from said EGR abnormality determining zone discriminating means and on a quantitative relation between a value of an EGR abnormality determining temperature which is obtained by the calculation of said operational conditions and an output signal of said second temperature detecting means, and a value of the temperature of the EGR passage detected by said first temperature detecting means.

2. The abnormality detecting device according to claim 1, wherein said parameters of the engine are an engine revolution number and a pressure in said intake air passage.

3. The abnormality detecting device according to claim 1, wherein said value of said EGR abnormality determining temperature is calculated by the sum of a value of a temperature detected by said second temperature detecting means and a component of said EGR abnormality determining temperature value which is in proportion to the product of the value of pressure in said intake air passage and the value of an engine revolution number.

4. The abnormality detecting device according to claim 3, wherein a relation between said component of the EGR abnormality determining temperature value and said product of the value of pressure in said intake air passage and the value of said engine revolution number is stored in a computer in a form of a map.

5. The abnormality detecting device according to claim 1, wherein a first timer is coupled to said EGR abnormality determining zone discriminating means and delays the operation of said abnormality determining means and delays the operation of said abnormality determining means a predetermined time after the discrimination of said EGR abnormality determining zone discriminating means.

6. The abnormality detecting device according to claim 1, wherein a second timer means is coupled to said abnormality determining means and delays the setting of an EGR abnormality flag a predetermined time after the operation of said abnormality determining means.

* * * *